US005558259A

United States Patent [19]

Izzo

[11] Patent Number: 5,558,259

[45] Date of Patent: Sep. 24, 1996

[54] GOLF BAG WITH DUAL CARRYING STRAPS

[75] Inventor: Theodore-James Izzo, Evergreen, Colo.

[73] Assignee: Izzo Systems, Inc., Wheatridge, Colo.

[21] Appl. No.: 313,377

[22] Filed: Sep. 27, 1994

[51] Int. Cl.[6] ..... A45F 3/04

[52] U.S. Cl. ..... 224/627; 224/257; 224/259; 206/315.3; 224/608; 224/643

[58] Field of Search ..... 224/202, 209–215, 224/257, 258, 259; 206/315.2, 315.3, 315.5

[56] References Cited

U.S. PATENT DOCUMENTS

| | | | |
|---|---|---|---|
| D. 362,752 | 10/1995 | Steurer | 224/209 |
| 1,570,500 | 1/1926 | Kennedy | 224/209 |
| 2,224,568 | 12/1940 | Altorfer | 224/209 |
| 2,820,498 | 1/1958 | Endee | 150/1.5 |
| 2,853,111 | 9/1958 | Williams | 150/1.5 |
| 4,018,369 | 4/1977 | Jaeger | 224/209 |
| 4,487,347 | 12/1984 | Zegar | 224/259 |
| 4,911,347 | 3/1990 | Wilhite | 224/259 |
| 5,038,984 | 8/1991 | Izzo | 224/209 |
| 5,042,703 | 8/1991 | Izzo | 224/209 |
| 5,042,704 | 8/1991 | Izzo | 224/209 |
| 5,112,068 | 5/1992 | Liao et al. | 206/315.3 |
| 5,269,449 | 12/1993 | Sattler | 224/258 |
| 5,348,205 | 9/1994 | Steurer | 224/209 |
| 5,419,473 | 5/1995 | Lamar | 224/215 |
| 5,429,288 | 7/1995 | Sattler | 224/257 |

*Primary Examiner*—Henry J. Recla
*Assistant Examiner*—Gregory M. Vidovich
*Attorney, Agent, or Firm*—Sheridan Ross & McIntosh

[57] ABSTRACT

A golf bag with a dual carrying strap assembly. In one embodiment, the strap assembly includes a first strap which is attached to the golf bag and interfaces with the golf bag at first and second longitudinally displaced locations. The strap assembly also includes a separate second strap which is also attached to the golf bag and which one end thereof interfaces with the golf bag at the second location and which its other end either interfaces with the golf bag at this same second location or at an intermediate location, such as at the carrying handle of the golf bag. Nonetheless, the two separate straps form two loops such that the golf bag may be supported on both of the golfer's shoulders.

18 Claims, 4 Drawing Sheets

GOLF BAG WITH DUAL CARRYING STRAPS

FIELD OF THE INVENTION

The present invention generally relates to the field of golf bags and, more particularly, to golf bags having dual carrying straps.

BACKGROUND OF THE INVENTION

Significant efforts have been expended in golf bag development. A large portion of these efforts have been directed to enhance the comfort of the individual that carries the golf bag. For instance, the weight of the golf bag has been significantly reduced in recent years. Moreover, the structure of the golf bag itself has undergone significant modifications to make the bag both more easy to carry and use, as well as to reduce the stress on the carrier of the bag as much as possible. Furthermore, various types of dual strap carrying systems for golf bags have been developed, one of which is the Izzo® Dual Strap which is the subject of U.S. Pat. Nos. 5,038,984, 5,042,703, and 5,042,704.

The Izzo® Dual Strap in its present form has realized significant commercial success. The Izzo Dual Strap is generally a Y-shaped harness to provide for engagement of both of the golfer's shoulders in a desired manner. The end of the vertically extending portion of the Y-shaped harness is typically attached to the small carrying handle of the golf bag, and the remaining two ends of the harness are attached to opposite sides of the handle. For instance, one of these ends is typically attached proximate the open end of the bag, while the remaining end engages that portion of the golf bag which interacts with the bag stand and associated harness. Consequently, the carrier of the bag may insert each arm through one of the two loops provided by the attached harness such that the weight of the bag may be substantially evenly distributed over both shoulders.

SUMMARY OF THE INVENTION

Generally, the present invention is a golf bag which includes an enclosure for the golf clubs and a dual carrying strap system. A first strap having two ends interfaces with the enclosure at first and second spaced locations along the length of the enclosure, the first location of which is generally proximate the open end of the enclosure. A second strap interfaces with the enclosure at the second location which may be, for example, a buckle or the like directly attached to the enclosure or a bag stand strap assembly for a bag stand. The two ends of the second strap may both interface with the enclosure at this second location to form a circular loop (i.e., such that the load of the enclosure borne by the second strap is concentrated at a single point, and further such that the enclosure is then supported at two locations while being carried), or one of the ends of the second strap may interface with the enclosure at a third location between the first and second locations, such as at the carrying handle (i.e., such that the enclosure is supported by the first and second straps at three displaced locations while being carried).

The present invention may adopt a number of variations of the foregoing. For instance, the two straps may each be separately detachably connectable to the enclosure. Moreover, the two straps may be completely separate from each other, the first strap being a conventional carrying strap typically provided with the golf bag and the second strap being effectively an accessory strap. Further in this regard, a buckle or other suitable coupling may be provided at the second location to provide a common interface for the first and second straps (e.g., the first and second straps may both be attached to this buckle, or one of the straps may be attached to the buckle and the other may pass therethrough and engage a bag stand strap assembly for controlling a bag stand). However, the first and second straps may also be joined in generally end-to-end fashion to effectively form a generally linearly extending strap, or may in fact comprise a single strap of sufficient length to form a dual carrying strap system. In this case, a buckle at the second location on the golf bag may slidably engage the resulting strap such that the size of the two loops formed by attachment of such to the enclosure in the above-described manner is adjustable merely by sliding the resulting strap relative to the buckle. This type of integration of the strap assembly to the enclosure of the golf bag thereby readily accommodates certain physical differences between golfers, as well a shifting of the bag's position while being carried by a particular golfer. However, even if the first and second straps are separate, the size of the two loops formed by the noted manner of interconnection may be adjusted to be of substantially equal size, or such that one loop is bigger than the other.

DETAILED DESCRIPTION

The present invention will be described with reference to the accompanying drawings which assist in illustrating its various features. Generally, the present invention is a golf bag which has a strap assembly with dual carrying straps.

Figure 1:
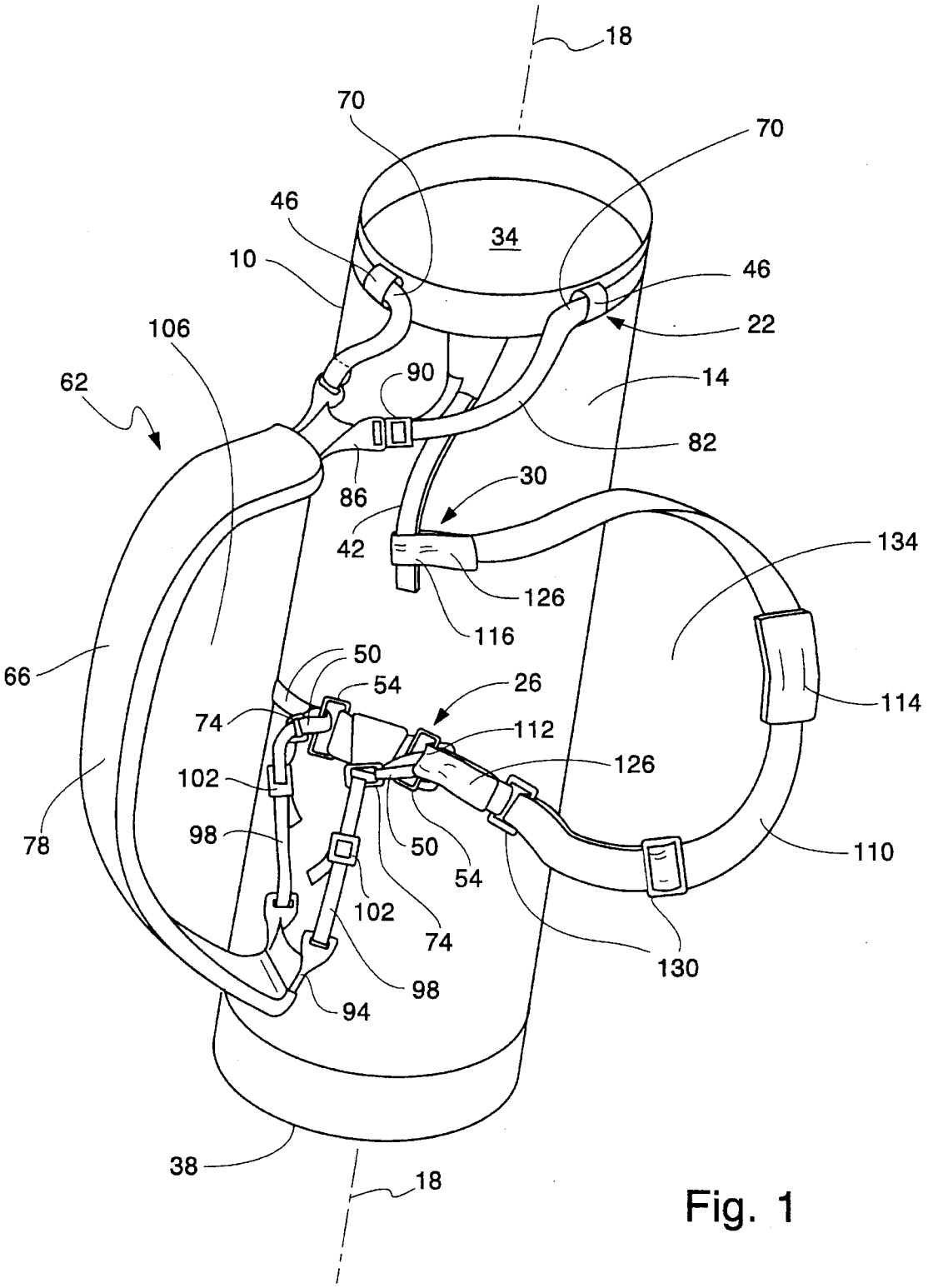
FIG. 1 is a perspective view of a golf bag in accordance with principles of the present invention which utilizes a three-point connection for its strap assembly.

Referring to FIG. 1, the golf bag 10 includes an enclosure 14 and a strap assembly 62. The particular structural configuration of the enclosure 14 is immaterial for purposes of the present invention. For instance, the enclosure 14 may assume a variety of shapes and may include a bag stand (not shown) of the type known in the art. In such a case, the bag stand (not shown) may be controlled/activated by the strap assembly 62. Nonetheless, the enclosure 14 generally extends longitudinally along an axis 18 and it has an open end 34 for inserting golf clubs therein and a closed end 38 for retaining the clubs within the enclosure 14.

Generally, the strap assembly 62 of FIG. 1 provides for a three-point connection for the golf bag 10 (e.g., the strap assembly 62 supports the load of the enclosure 14 and its contents over three generally longitudinally spaced locations). In this regard, the strap assembly 62 engages/interfaces the enclosure at first, second and third locations 22, 26, and 30, respectively. Generally, the first location 22 is proximate the open end 34, the second location 26 is longitudinally displaced from the first location 22, and the third location 30 is positioned between the first and second locations 22, 26, respectively. For instance, the third location 30 may be proximate, disposed adjacent to, or at the carrying handle 42 of the golf bag 10. Nonetheless, the first, second, and third locations 22, 26, 30, respectively, are defined as generally longitudinal positions on the enclosure 14 such that, for instance, each of the three locations 22, 26, or 30 may be a single point or may be two or more laterally adjacent points on the enclosure 14 (i.e., at substantially the same or approximate longitudinal position on the enclosure 14, but laterally displaced). Moreover, the strap assembly 62 need only interface with the enclosure 14 at these three longitudinally spaced locations. That is, the various portions of the strap assembly 62 may be directly attached to the enclosure 14 at these locations, or they may merely interconnect with other structure which is actually movable relative to the enclosure 14 at one or more of these locations, such as in the case of a bag stand strap assembly to be discussed below.

Continuing to refer to FIG. 1, the strap assembly 62 includes a first strap 66 and a separate second strap 110. A first end 70 of the first strap 66 engages the enclosure 14 at the first location 22 and a second end 74 of the first strap 66 interfaces with the enclosure 14 at the second location 26 (i.e., the second end 74 of the first strap 66 actually engages the bag stand straps 50, and is thus movable relative to the enclosure 14 as will be discussed below). A first end 112 of the second strap 110 is also attached to the enclosure 14 at the second location 26, and a second end 116 of the second strap 110 is attached to the enclosure 14 at the third location 30. Consequently, the attachment of the straps 66, 110 to the enclosure 14 in this manner provides first and second loops 106, 134, respectively, through which a golfer's arms would be separately inserted to carry the golf bag 10.

Preferably, both ends of the first strap 66 are each detachably connectable to the enclosure 14. Any number of types of detachable connections may be utilized as one of skill in the art will recognize. However, in the illustrated embodiment and referring to FIG. 2 in which the second strap 110 is not shown to enhance the illustration of the first strap 66 and its connections, the first strap 66 includes a padded section 78 having an upper buckle assembly 86 attached thereto which interconnects with an upper jumper strap 82. The upper jumper strap 82 circumscribes the upper portion of the enclosure 14 and is retained thereagainst by loops or sleeves 46 attached to the enclosure 14. The upper jumper strap 82 includes an upper jumper strap adjustment buckle 90 such that the length of the upper jumper strap 90 may be adjusted. This type of first strap 66 thus not only provides for a detachable connection of the first strap 66 to the upper portion of the enclosure 14, but also allows the length of the first strap 66, and thus the size of the first loop 106, to be adjusted. Notwithstanding the foregoings it will be appreciated that other types of connections may be utilized (e.g., a buckle on the enclosure 14 and a snap-on clip on the first end of the first strap 66 or a self attaching velcro assembly). Moreover, it will be appreciated that the first end 70 may be a single strap portion, or multiple strap portions.

Figure 2:
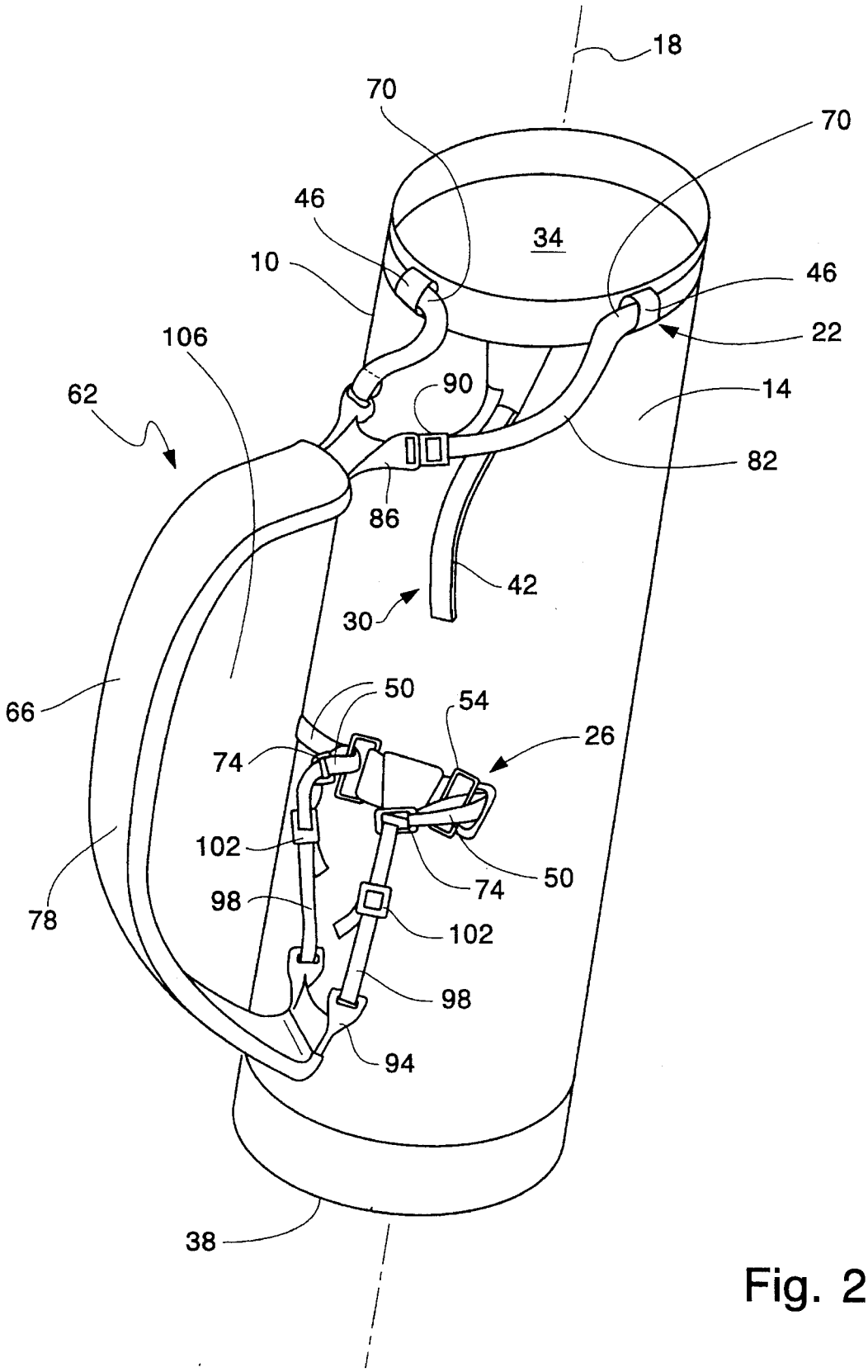
FIG. 2 is the golf bag of FIG. 1 with the second strap removed therefrom for better illustration of the first strap.

Continuing to refer to FIG. 2, the first strap 66 also includes a lower buckle assembly 94 attached to the lower end of the padded section 78 which interconnects with two lower jumper straps 98. The lower jumper straps 98 each loop around a corresponding bag stand strap 50 which in turn engages the bag stand (not shown). The lower jumper straps 98 and their corresponding bag stand straps 50 each pass through a buckle 54 or other appropriate connector which is attached to the enclosure 14. Consequently, when the first strap 66 is engaged by the golfer, the bag stand (not shown) is retracted by the lower jumper straps 98 pulling the corresponding bag stand straps 50 outwardly relative to the enclosure 14. Each of the lower jumper straps 98 also include a lower jumper strap adjustment buckle 102 such that the length of each of the lower jumper straps 98 may be adjusted. This type of first strap 66 again thus not only provides for a detachable connection of the first strap 66 to the second location 26 of the enclosure 14, but also further allows the length of the first strap 66, and thus the size of the first loop 106, to be adjusted. Again, notwithstanding the foregoing, it will be appreciated that other types of connections may be utilized depending upon the desired end result or the physical configuration of the bag. Moreover, it will be appreciated that second end(s) 74 may be attached to the enclosure 14 at a fixed location and that the second end 74 may be a single strap portion or multiple strap portions.

The second strap 110, illustrated in FIG. 1, is also preferably detachably connectable to the enclosure 14 by any number of types of detachable connectors. In the illustrated embodiment, the second strap 110 includes a padded section 114 and has self attaching velcro connectors 126 such that the second end 116 may be looped around the carrying handle 42 and such that the first end 112 may be looped around one of the buckles 54 which is again attached to the enclosure 14. The second strap 110 may include a second strap adjusting buckle system 130 (an end and intermediate buckle) such that the length of the second strap 110 may be adjusted. This type of construction for the second strap 110 thus not only provides for a detachable connection of the second strap 110 to the enclosure 14, but also allows the length of the second strap 110, and thus the size of the second loop 134, to be adjusted.

Figure 3:
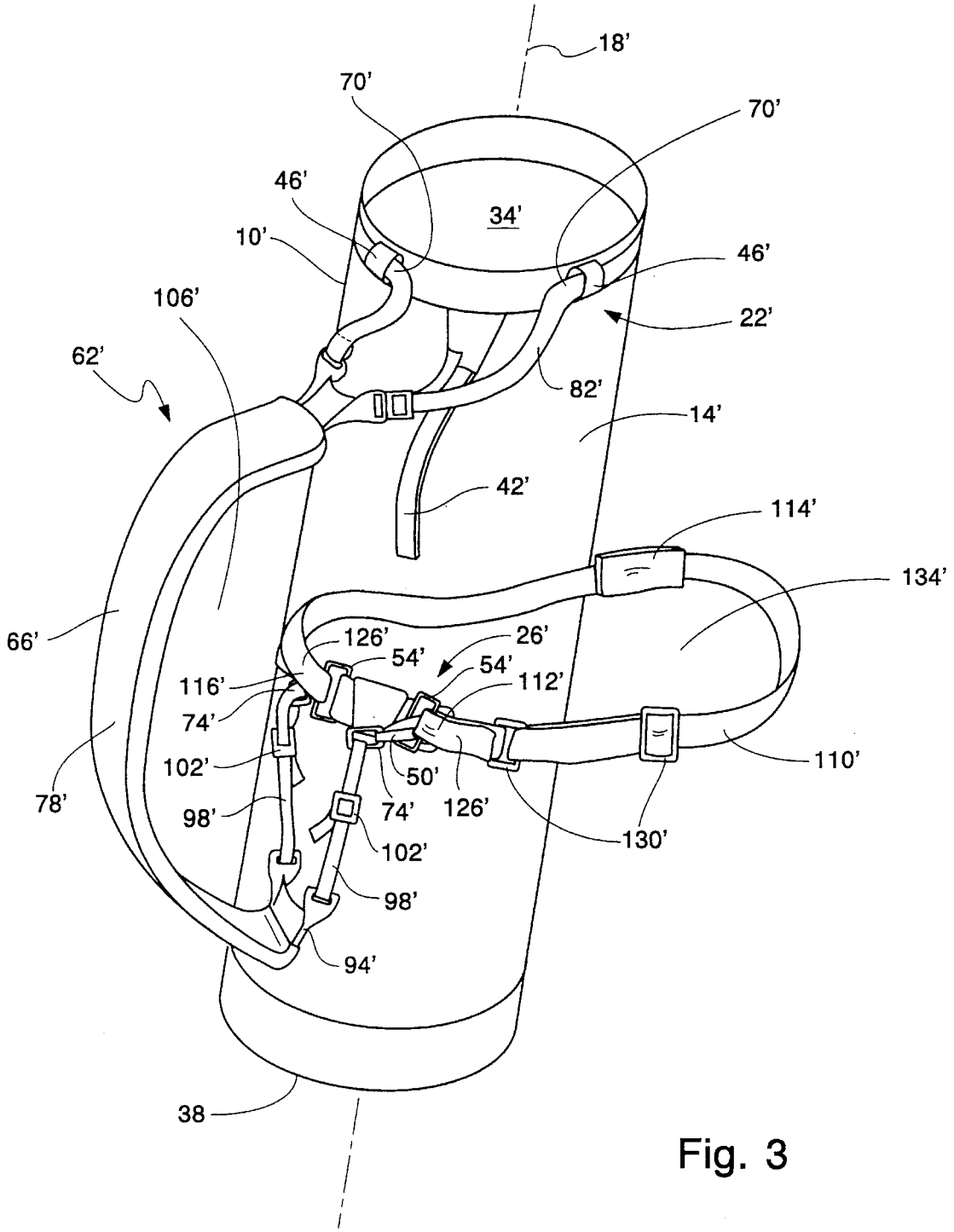
FIG. 3 is a perspective view of another golf bag in accordance with principles of the present invention which utilizes a two-point connection for its strap assembly.

A variation of the strap assembly 62 of FIG. 1 is illustrated in FIG. 3. Generally, the strap assembly 62' is structurally the same as the strap assembly 62, but is interconnected with the enclosure 14' in a different manner. Summarily, the strap assembly 62' provides a two-point connection for the golf bag 10' (e.g., the strap assembly 62' supports the load of the enclosure 14' over two longitudinally spaced locations, versus the three-point connection provided for the golf bag 10). In this regard, the strap assembly 62' engages the enclosure at first and second locations 22', 26', respectively. Generally, the first location 22' is again proximate the open end 34' and the second location 26' is longitudinally displaced from the first location 22' and is thus between the first location 22' and the closed end 38' of the enclosure 14'.

As noted, aside from the points of connection, the structure of the strap assembly 62' is similar to the strap assembly 62 of FIG. 1. Consequently and continuing to refer to FIG. 3, the strap assembly 62' includes a first strap 66' and a separate second strap 110'. The first strap 66' may be interconnected with the enclosure 14' in the same manner as the first strap 66 discussed above and illustrated in FIGS. 1–2. However, the first and second ends 112', 116' of the second strap 110' in this instance are both attached to the enclosure 14' at or substantially proximate the second location 26'. The first and second ends 112', 116' of the second strap 110 may be attached to a single buckle 54' (not shown), or one may be attached to two separate buckles 54', depending for instance upon the construction of the bag. Nonetheless, both the first and second straps 66', 110' may be detachably connectable to the enclosure 14' in the manner disclosed with regard to the embodiments of FIGS. 1 and 2. As will be appreciated, the attachment of the first and second straps 66', 110' to the enclosure 14' in the illustrated and noted manner still provides first and second loops 106', 134', respectively, through which a golfer's arms would be separately inserted to carry the golf bag 10'. In this regard, the golf bag 10' may utilize length adjustment features similar to the bag 10 for varying the size of the first and second loops 106', 134' as discussed above.

Figure 4:
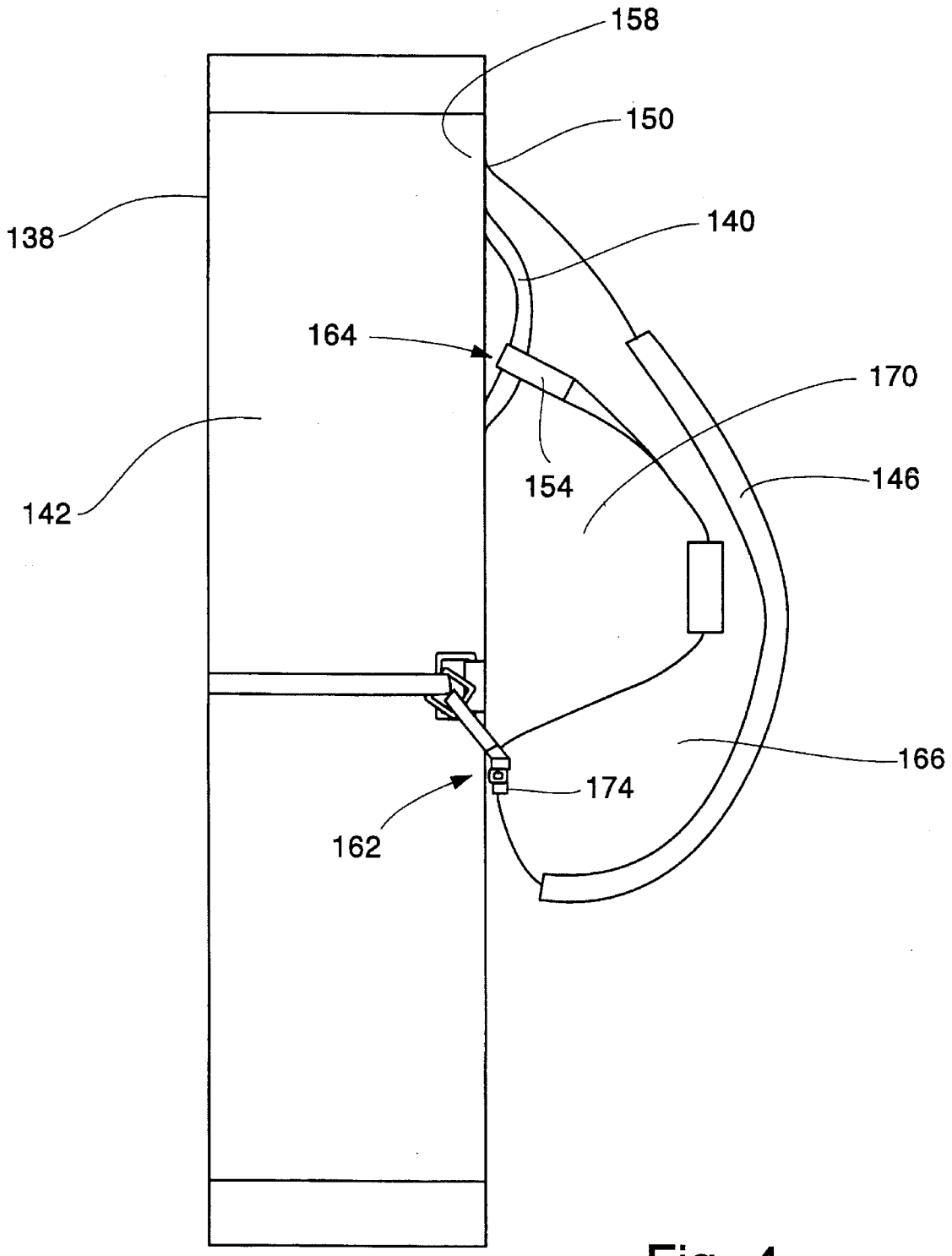
FIG. 4 is a perspective view of another golf bag in accordance with principles of the present invention which utilizes a three-point connection for its strap assembly.

Another embodiment of the present invention is illustrated in FIG. 4. Instead of using a first strap 66 and a completely separate second strap 110, the golf bag 138 utilizes a functionally single, generally axially or linearly extending strap 146. The strap 146 may actually be formed by joining multiple sections or may be continuously formed. Regardless of its manner of construction, the first end 150 of the strap 146 is attached to the enclosure 142 at the first location 158 in any suitable manner. The strap 146 then passes through a buckle 174 or other suitable coupling positioned at the second location 162 which slidably interconnects the strap 146 and enclosure 142. The buckle 174 may interconnect the strap 146 with the bag stand strap assembly (not shown) of a bag stand (not shown) in which case buckle 174 would be movable relative to the enclosure 142, or it may be attached to the enclosure 142 to provide for a fixed connection. The second end 154 of the strap 146 interconnects with the enclosure 142 at the third location 164, such as at the carrying handle 140 or any other suitable location between the first location 158 and second location 162. Suitable connectors (not shown) such as those discussed above may be positioned on the two ends of the strap 146 for attaching the same to the enclosure 142. In this type of configuration, the relative size of the first and second loops 166, 170 may be adjusted by merely sliding the strap 146 relative to the buckle 174. For instance, this sliding may result in the loops 166, 170 being of substantially the same size, or one of the loops being bigger than the other. This slidable interface between the strap 146 and enclosure 142 for a given length of the strap 146 provides for a degree of automatic adjustment of the size of the loops 166, 170 (e.g., to accommodate different physical characteristics of golfers, as well as a shifting of the position of the bag 138 by a given golfer in use which may require a variation of the size of the loops 166, 170, or make such a variation desirable). As in the above-described embodiments, the overall length of the strap 146 may also be adjusted.

The foregoing description of the invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known of practicing the invention and to enable others skilled in the art to utilize the invention in such, or other, embodiments and with the various modifications required by the particular applications or uses of the invention. It is intended that the appended the claims be construed to include alternative embodiments to the extent permitted by the prior art.

What is claimed is:

1. A golf bag, comprising:

a generally longitudinally extending enclosure having an open end and a closed end;

a first strap having first and second end portions which interface with said elongated enclosure at first and second longitudinally displaced locations on said enclosure, respectively, said first location being generally proximate said open end; and a second strap having first and second end portions which interface with said elongated enclosure at said second location and at a third location, respectively, said third location being longitudinally displaced from said closed end a distance at least as great as a distance that said second location is longitudinally displaced from said closed end and less than said first location is longitudinally displaced from said closed end.

2. A golf bag, as claimed in claim 1, wherein:

said first and second straps are separate.

3. A golf bag, as claimed in claim 1, wherein:

said second end portion of said first strap and said second end portion of said second strap interface with a common coupling whereby said second and third locations are substantially overlapping, said coupling being attached to said enclosure.

4. A golf bag, as claimed in claim 1, wherein:

said first and second end portions of said first strap are each detachably connectable to said enclosure.

5. A golf bag, as claimed in claim 1, wherein:

said first and second end portions of said second strap are each detachably connectable to said enclosure.

6. A golf bag, as claimed in claim 1, further comprising:

a carrying handle positioned between said first and second locations and defining said third location.

7. A golf bag, as claimed in claim 1, wherein:

said second and third locations occupy substantially the same longitudinal position on said enclosure.

8. A golf bag, as claimed in claim 1, wherein:

said second end portion of said first strap and said first end portion of said second strap are joined together to define a substantially continuous strap assembly.

9. A golf bag, as claimed in claim 8, further comprising:

a coupling attached to said enclosure at said second location, wherein said strap assembly is slidably interconnected with said coupling.

10. A golf bag, as claimed in claim 1, wherein:

said first and second straps define first and second loops, respectively, wherein a size of each of said first and second loops is adjustable.

11. A golf bag, as claimed in claim 1, wherein:

said first and second straps define first and second loops, respectively, wherein a length of said first and second straps is selected whereby said first and second loops are extended a substantially equal distance from said enclosure when positioned on a golfer's shoulders.

12. A golf bag, as claimed in claim 1, wherein:

said first and second straps define first and second loops, respectively, wherein a length of said first and second straps is selected whereby said first loop when positioned on one of a golfer's shoulders is a greater extended distance from said enclosure than said second loop when positioned on the golfer's opposing shoulder.

13. A golf bag, as claimed in claim 1, wherein:

said first and second straps define first and second loops, respectively, wherein a length of said first and second straps is selected whereby said first loop when positioned on one of a golfer's shoulders is extended a shorter distance from said enclosure than said second loop when positioned on the golfer's opposing shoulder.

14. A golf bag, comprising:

a generally longitudinally extending enclosure having an open end and a closed end, said enclosure further comprising a coupling attached to said enclosure between said open and closed ends and a carrying handle between said coupling and said open end; and a single strap interconnected with said enclosure and having first and second ends, said first end being attached to said enclosure at a first location on said enclosure generally proximate said open end, said second end of said strap being looped through said coupling and passed back up towards and attached to said enclosure at said carrying handle, wherein said strap defines first and second loops for engagement by a carrier of said golf bag.

15. A golf bag, comprising:

a generally longitudinally extending enclosure having an open end and a closed end;

a first strap having first and second end portions which interface with said elongated enclosure at first and second longitudinally displaced locations on said enclosure, respectively, said first location being generally proximate said open end; and a second strap, separate from said first strap, having first and second end portions which interface with said elongated enclosure at locations which are longitudinally displaced from said closed end a distance no greater than a distance that said second location is longitudinally displaced from said closed end.

16. A golf bag, as claimed in claim 1, wherein:

said first and second end portions of said second strap interface with said elongated enclosure at said second location and at a third location, respectively, said second and third locations a substantially equal longitudinal distance from said closed end.

17. A golf bag, as claimed in claim 16, wherein:

said second end portion of said first strap and said second end portion of said second strap interface with a common coupling whereby said second and third locations are substantially overlapping, said coupling being attached to said enclosure.

18. A golf bag, as claimed in claim 16, wherein:

said second and third locations occupy substantially the same longitudinal position on said enclosure.

* * * * *